US007772956B2

(12) United States Patent
Toi et al.

(10) Patent No.: US 7,772,956 B2
(45) Date of Patent: Aug. 10, 2010

(54) MULTILAYER TRANSFORMER COMPONENT

(75) Inventors: Takaomi Toi, Moriyama (JP); Kosuke Ishida, Ritto (JP); Daisuke Ishide, Ritto (JP); Kazuhide Kudo, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/483,279

(22) Filed: Jun. 12, 2009

(65) Prior Publication Data

US 2009/0243777 A1 Oct. 1, 2009

Related U.S. Application Data

(63) Continuation of application No. PCT/JP2008/051392, filed on Jan. 30, 2008.

(30) Foreign Application Priority Data

Feb. 27, 2007 (JP) ..... 2007-047299

(51) Int. Cl.
*H01F 5/00* (2006.01)

(52) U.S. Cl. ..... 336/200; 336/232; 336/223

(58) Field of Classification Search ..... 336/200, 336/223, 232

See application file for complete search history.

(56) References Cited

U.S. PATENT DOCUMENTS 6,356,181 B1 * 3/2002 Kitamura ..... 336/200
7,408,435 B2 * 8/2008 Nishikawa et al. ..... 336/200
2002/0093415 A1 * 7/2002 Kitamura ..... 336/200
2003/0076211 A1 * 4/2003 Matsuta et al. ..... 336/200

FOREIGN PATENT DOCUMENTS

| | | | |
|---|---|---|---|
| EP | 1 635 363 | A1 | 3/2006 |
| JP | 2001-160510 | A | 6/2001 |
| JP | 2005-085786 | A | 3/2005 |
| JP | 2005-158975 | A | 6/2005 |
| JP | 2005-341359 | A | 12/2005 |

OTHER PUBLICATIONS

Official Communication issued in International Patent Application No. PCT/JP2008/051392, mailed on May 13, 2008.

* cited by examiner

*Primary Examiner*—Anh T Mai
(74) *Attorney, Agent, or Firm*—Keating & Bennett, LLP

(57) ABSTRACT

A multilayer transformer component includes a chip body including a primary-side coil and a secondary-side coil, and first to fourth external electrodes. The primary-side coil includes a body portion, a first lead, and a second lead, and the secondary-side coil includes a body portion, a third lead, and a fourth lead. A first projection and a second projection of each body portion are arranged to lie substantially on a linear line. The first lead and the fourth lead are arranged to be line-symmetrical with respect to a center line which is arranged at an approximate center between respective distal ends of the first projection and the second projection, and which is perpendicular or substantially perpendicular to an overlying direction of the primary-side and secondary-side coils. The second lead and the third lead are also arranged to be line-symmetrical with respect to the center line.

2 Claims, 9 Drawing Sheets

MULTILAYER TRANSFORMER COMPONENT

BACKGROUND OF THE INVENTION

1. Field of the Invention

The present invention relates to a multilayer transformer component used as, e.g., a balun transformer and a common-mode choke coil.

2. Description of the Related Art

Demands for smaller sizes and higher density have increased in the field of transformer components. To meet these demands, a multilayer transformer component is proposed which is formed by, e.g., photolithography capable of performing microfabrication (see, for example, Japanese Unexamined Patent Application Publication No. 2005-158975).

FIG. 16 is a perspective view of a known multilayer transformer component, the view illustrating coil portions in a see-through manner, and FIGS. 17A and 17B are plan views illustrating connection states of external electrodes and coils.

As illustrated in FIG. 16, a multilayer transformer component 100 includes a primary-side coil 101 and a secondary-side coil 102 that are disposed in an insulator 110 which is sandwiched between magnetic base plates, and external electrodes 121 to 124 provided on an outer surface of such a chip body that are connected to the primary-side and secondary-side coils 101, 102.

More specifically, as illustrated in FIG. 17A, an outer end 101*a* and an inner end 101*b* of the primary-side coil 101 are respectively connected to the external electrodes 121 and 123, which are arranged opposite to each other. Also, as illustrated in FIG. 17B, an outer end 102*a* and an inner end 102*b* of the secondary-side coil 102 are respectively connected to the external electrodes 122 and 124, which are arranged opposite to each other.

However, the above-described known multilayer transformer component 100 has the following problems.

In the known multilayer transformer component 100, the outer end 101*a* and the inner end 101*b* of the primary-side coil 101 are respectively connected to the external electrodes 121 and 123, which are arranged opposite to each other, as illustrated in FIG. 17A, and the outer end 102*a* and the inner end 102*b* of the secondary-side coil 102 are respectively connected to the external electrodes 122 and 124, which are arranged opposite to each other, as illustrated in FIG. 17B. Therefore, a difference occurs between an inductance value of the primary-side coil 101 and an inductance value of the secondary-side coil 102.

More specifically, as illustrated in FIG. 17A, because a current I flowing through an intermediate portion 101*c* extending from a coil body of the primary-side coil 101 to the outer end 101*a* is in a reverse direction from the current I flowing through a body portion 101*e* of the primary-side coil 101, an inductance value of the intermediate portion 101*c* is significantly reduced due to the cancellation of magnetic forces. Furthermore, because the current I flowing through an intermediate portion 101*d* extending from the coil body to the inner end 101*b* is in a reverse direction from the current I flowing through the body portion 101*e*, an inductance value of the intermediate portion 101*d* is also significantly reduced.

In the secondary-side coil 102, as illustrated in FIG. 17B, a portion in which a current flows in a reverse direction from that of the current flowing through an intermediate portion 102*c* extending from a coil body of the secondary-side coil 102 to the outer end 102*a* is not present near the intermediate portion 102*c*. Furthermore, a current flowing in a reverse direction from that of the current flowing through an intermediate portion 102*d* extending from the coil body to the inner end 102*b* is also not present near the intermediate portion 102*d*. Thus, a portion in which an inductance value is significantly reduced by the cancellation of magnetic forces is not present. Accordingly, the inductance value of the secondary-side coil 102 is greater than that of the primary-side coil 101.

In the multilayer transformer component 100, as described above, because a difference occurs in inductance value between the primary-side coil 101 and the secondary-side coil 102, an insertion loss characteristic of the multilayer transformer component 100 differs depending on a mounting direction. Therefore, when the multilayer transformer component 100 is used as a common-mode choke coil, a noise removing effect also differs depending on the mounting direction. When the multilayer transformer component 100 is used as a balun transformer, there is a risk that characteristics of an output signal differ depending on the mounting direction and a characteristic variation increases.

SUMMARY OF THE INVENTION

To overcome the problems described above, preferred embodiments of the present invention provide a multilayer transformer component having a structure which does not cause a difference in the inductance value between a primary-side coil and a secondary-side coil, and which maintains desired characteristics regardless of a mounting direction of the component.

A multilayer transformer component according to a preferred embodiment of the present invention includes a chip body including a primary-side coil and a secondary-side coil, which are layered within an insulator and which include body portions having the same or substantially the same shape and which are wound in the same winding direction, and further including a first external electrode provided on a first end surface of the chip body, a second external electrode provided on the first end surface in a side-by-side relation to the first external electrode, a third external electrode provided on a second end surface arranged opposite to the first end surface and which is arranged opposite to the first external electrode, and a fourth external electrode provided on the second end surface in a side-by-side relation to the third external electrode and which is arranged opposite to the second external electrode, wherein each of the body portions of the primary-side coil and the secondary-side coil includes a first projection arranged to project from an outermost peripheral winding of the body portion toward the first end surface and a second projection projecting beyond the outermost peripheral winding toward the second end surface, the first and second projections being arranged to lie along a linear line which is perpendicular or substantially perpendicular to the first and second end surfaces, wherein a first lead that is led out from a distal end of the first projection of the body portion in the primary-side coil is connected to the first external electrode, and a second lead that is led out from a distal end of the second projection of the body portion therein is connected to the fourth external electrode, wherein a third lead that is led out from a distal end of the first projection of the body portion in the secondary-side coil is connected to the second external electrode, and a fourth lead that is led out from a distal end of the second projection of the body portion therein is connected to the third external electrode, and wherein the first lead and the fourth lead are arranged to be line-symmetrical with respect to a center line which is located at an approximate center between the distal end of the first projection and the distal end of the second projection when viewed in an overlying direction of the primary-side coil and the secondary-side coil, and which is perpendicular or substantially perpendicular to the overlying direction, and the second lead and the third lead are arranged to be line-symmetrical with respect to the center line when viewed in the overlying direction.

With such a configuration, by connecting the first external electrode and the third external electrode to main lines and connecting the fourth external electrode to a sub-line while the second external electrode is grounded, the multilayer transformer component functions as a balun transformer in which an unbalanced signal input through the first external electrode is output as balanced signals from the third and fourth external electrodes.

Since the body portions of the primary-side coil and the secondary-side coil have the same or substantially the same shape and are wound in the same winding direction, signals having the same or substantially the same power as that of a signal input through the first external electrode can be simultaneously output from the third and fourth external electrodes. In other words, the multilayer transformer component according to a preferred embodiment of the present invention can be operated to function as a balun transformer of (1:1).

Furthermore, the multilayer transformer component can also be operated to function as a balun transformer in which an unbalanced signal input through the second external electrode is output as balanced signals from the third and fourth external electrodes.

However, even with the body portions having the same or substantially the same shape and being wound in the same winding direction and with the body portions having the same or substantially the same inductance value, if the first lead and the second lead of the primary-side coil and the third lead and the fourth lead of the secondary-side coil differ in inductance value, a difference in inductance value occurs between the entire primary-side coil and the entire secondary-side coil. In such a state, an insertion loss characteristic differs between when the multilayer transformer component is mounted so as to input a signal through the first external electrode and when the multilayer transformer component is mounted so as to input a signal through the second external electrode. Thus, such dependency on the mounting direction of the multilayer transformer component causes a characteristic variation.

On the other hand, according to various preferred embodiments of the present invention, each of the body portions of the primary-side coil and the secondary-side coil includes the first projection arranged to project from the outermost peripheral winding of the body portion toward the first end surface and the second projection arranged to project beyond the outermost peripheral winding toward the second end surface, the first and second projections being arranged to lie on the linear line which is perpendicular or substantially perpendicular to the first and second end surfaces. Further, the first lead of the primary-side coil and the fourth lead of the secondary-side coil are arranged to be line-symmetrical with respect to the center line which is located at the approximate center between the distal end of the first projection of the body portion and the distal end of the second projection thereof when viewed in the overlying direction of the primary-side coil and the secondary-side coil, and which is perpendicular or substantially perpendicular to the overlying direction. In addition, the second lead of the primary-side coil and the third lead of the secondary-side coil are arranged to be line-symmetrical with respect to the center line when viewed in the overlying direction. As a result, the entire primary-side coil and the entire secondary-side coil have the same or substantially the same inductance value. Therefore, the multilayer transformer component according to a preferred embodiment of the present invention can function as a balun transformer of (1:1).

In addition, by connecting the first external electrode and the second external electrode to one of differential lines and connecting the third external electrode and the fourth external electrode to the other differential line, the multilayer transformer component according to a preferred embodiment of the present invention can function as a choke coil which has a desired characteristic to remove noise.

Preferably, the multilayer transformer component is a multilayer balun transformer.

Since the multilayer transformer component according to a preferred embodiment of the present invention is configured so as not to cause a difference in inductance value between the primary-side coil and the secondary-side coil, an insertion loss characteristic does not differ depending on the mounting direction of the multilayer transformer component. This results in an advantage that the desired operation characteristics are ensured regardless of the mounting direction.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the drawings.

Figure 1:
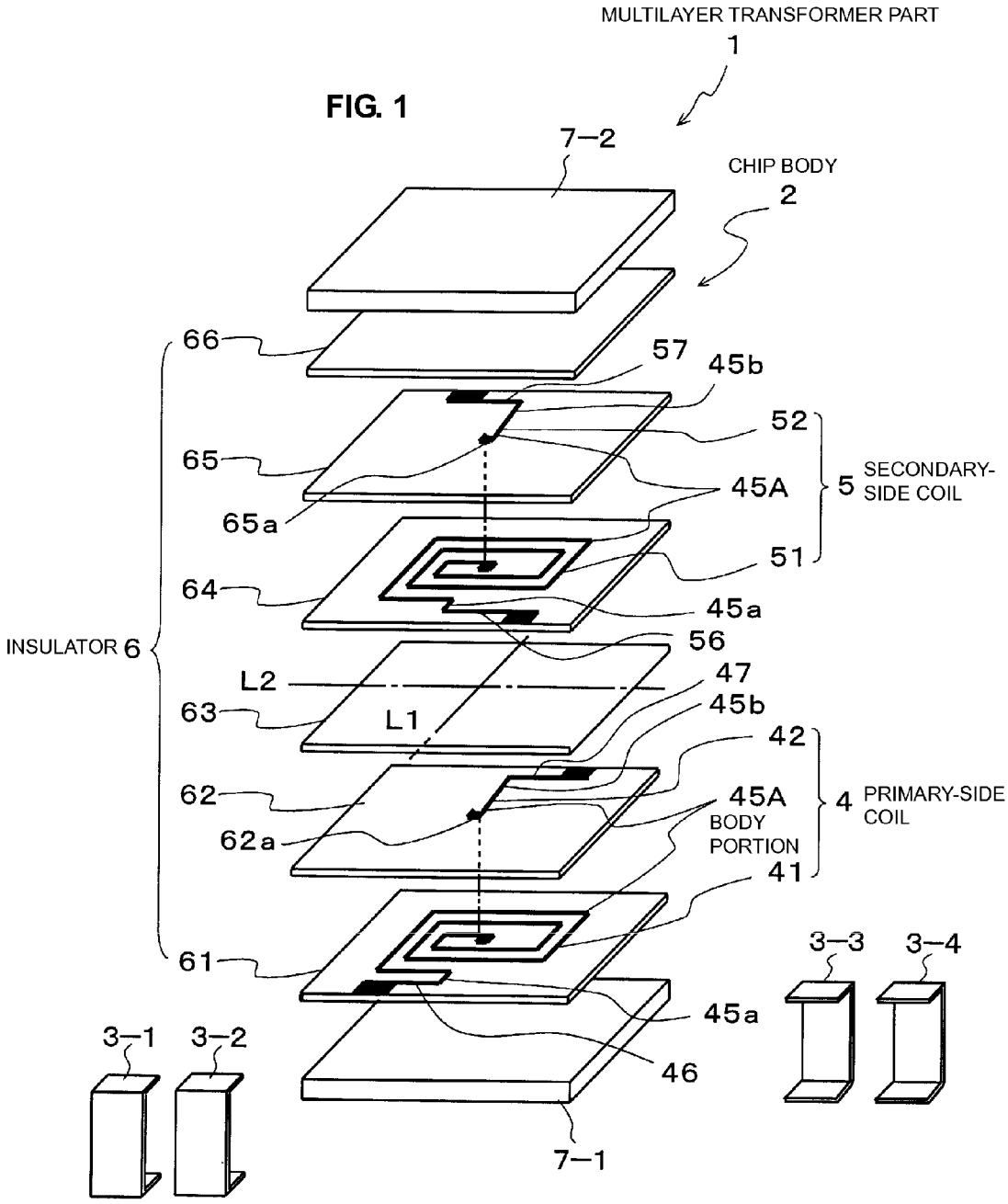
FIG. 1 is an exploded perspective view illustrating a multilayer transformer component according to a preferred embodiment of the present invention.
Figure 2:
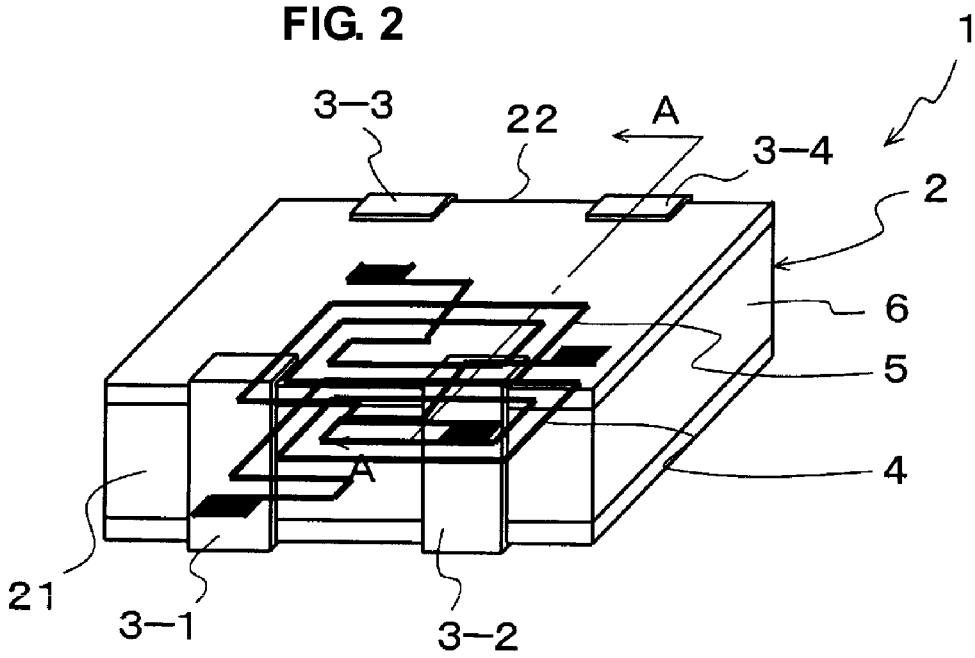
FIG. 2 is a perspective view of the multilayer transformer component illustrating a primary-side coil and a secondary-side coil in a see-through view.
Figure 3:
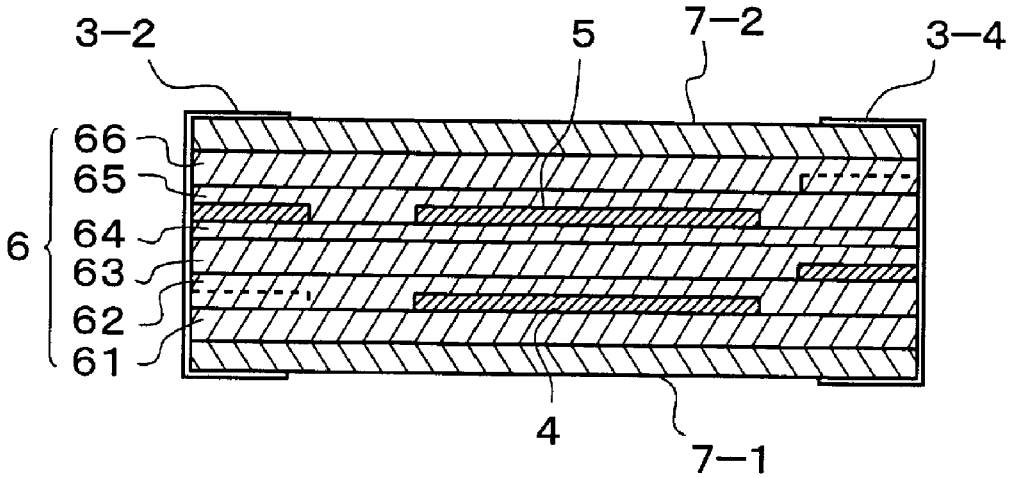
FIG. 3 is a sectional view taken along a line A-A in FIG. 2.

FIG. 1 is an exploded perspective view illustrating a multilayer transformer component according to a preferred embodiment of the present invention. FIG. 2 is a perspective view of the multilayer transformer component, the view illustrating a primary-side coil and a secondary-side coil in a see-through view. FIG. 3 is a sectional view taken along a line A-A in FIG. 2.

As illustrated in FIGS. 1 and 2, a multilayer transformer component 1 includes a chip body 2 and first to fourth external electrodes 3-1 to 3-4.

The chip body 2 includes a primary-side coil 4 and a secondary-side coil 5 that are layered within an insulator 6.

As illustrated in FIGS. 1 and 3, the insulator 6 is defined by insulating layers 61 to 66. The primary-side coil 4 and the secondary-side coil 5 are provided in predetermined ones of the insulating layers 61 to 66 by patterning, and the insulator 6 is sandwiched at upper and lower surfaces between a pair of ferrite base plates 7-1 and 7-2.

As illustrated in FIG. 1, preferably, the ferrite base plate 7-1 is disposed at a lowermost location, and the insulating layer 61 is formed on the ferrite base plate 7-1 through the steps of coating a photosensitive insulating paste over the ferrite base plate 7-1, and exposing and developing an entire or substantially an entire surface of the coated paste by photolithography. Then, a silver film is formed on the insulating layer 61 by sputtering. A photoresist (not shown) is coated over the silver film, and a pattern having the same or substantially the same shape as an electrode pattern 41 of the primary-side coil 4 is formed by photolithography. After dry etching, the photoresist is removed to form the electrode pattern 41 of the primary-side coil 4.

Thereafter, the insulating layer 62 having a via hole 62*a* is formed through the steps of coating a photosensitive insulating paste over the electrode pattern 41, and exposing and developing the coated paste by photolithography with a mask used to form the via hole. Furthermore, similar to the electrode pattern 41, another electrode pattern 42 of the primary-side coil 4 is formed through the steps of sputtering, photolithography, and dry etching.

Thus, the primary-side coil 4 having a spiral shape and including the electrode pattern 41 and the electrode pattern 42 is formed within the insulator 6.

The secondary-side coil 5 is formed substantially in the same manner as that for the primary-side coil 4.

More specifically, the insulating layer 64 is formed by photolithography on the insulating layer 63 covering the electrode pattern 42 of the primary-side coil 4. Then, an electrode pattern 51 of the secondary-side coil 5 is formed on the insulating layers 64 through the steps of sputtering, photolithography, and dry etching. Thereafter, the insulating layer 65 having a via hole 65*a* is formed by photolithography. Further, another electrode pattern 52 of the secondary-side coil 5 is formed on the insulating layer 65 in the same or substantially the same manner as that for the electrode pattern 51. Thus, the secondary-side coil 5 having a spiral shape and including the electrode pattern 51 and the electrode pattern 52 is formed within the insulator 6.

After covering the electrode pattern 52 with the insulating layer 66, the ferrite base plate 7-2 is bonded to the insulating layer 66 under pressure to form a wafer including many chip bodies. The wafer is cut by dicing to form chip bodies, and each chip body 2 is obtained after firing.

Finally, opposite ends of each chip body 2 are dipped in a silver paste and subjected to baking. Then, preferably by plating nickel, copper, or tin, for example thereon, the first to fourth external electrodes 3-1 to 3-4 are formed on first and second end surfaces 21, 22 of the chip body 2, as illustrated in FIG. 2. The multilayer transformer component 1 is thereby obtained.

The shapes of the primary-side coil 4 and the secondary-side coil 5 and the connection relationships between the primary-side and secondary-side coils 4, 5 and the first to fourth external electrodes 3-1 to 3-4 will be described below.

Figure 4:
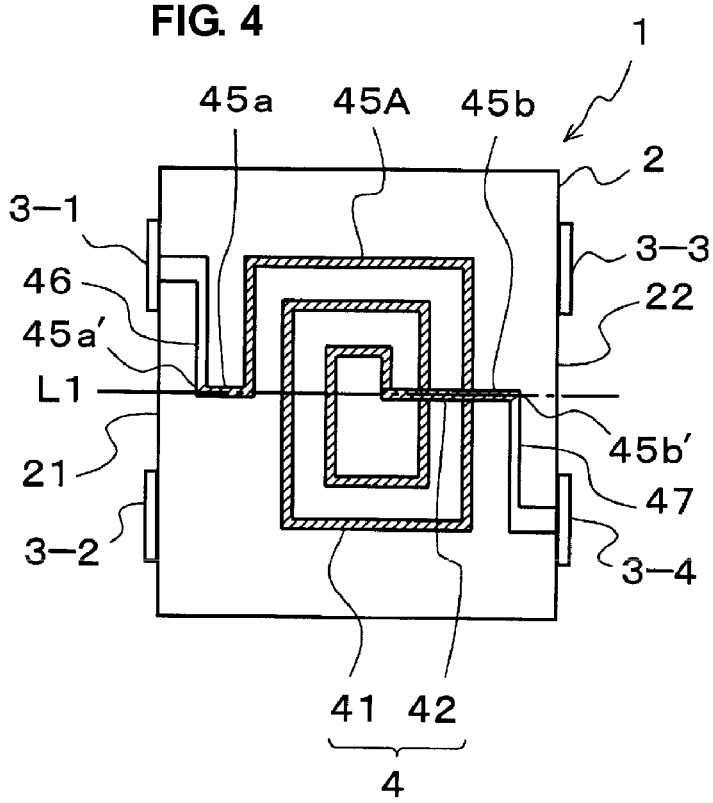
FIG. 4 is a plan view illustrating a state of the primary-side coil 4 when viewed from the upper side in a layer-overlying direction of the multilayer transformer component.
Figure 5:
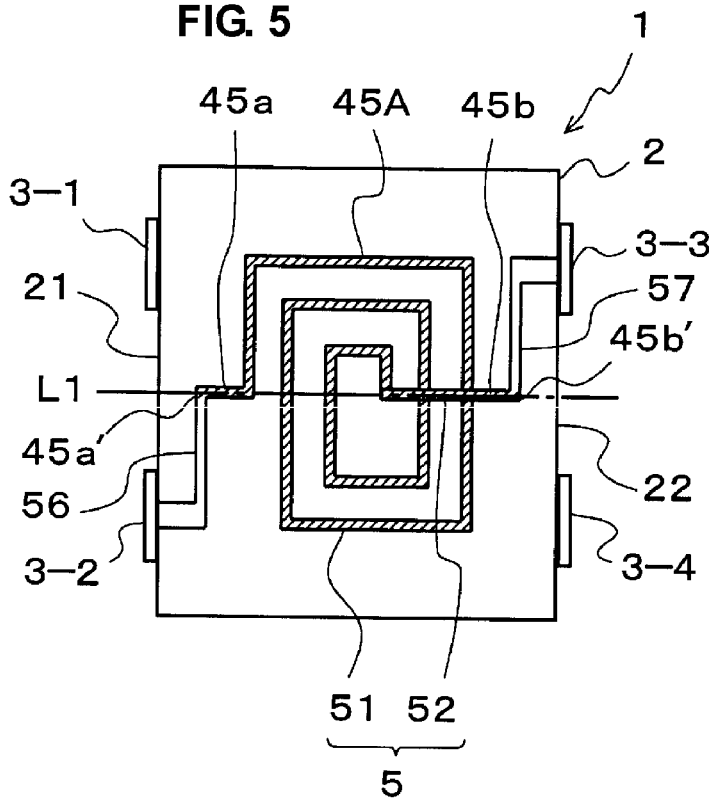
FIG. 5 is a plan view illustrating a state of the secondary-side coil when viewed from the upper side in the multilayer overlying direction.
Figure 6:
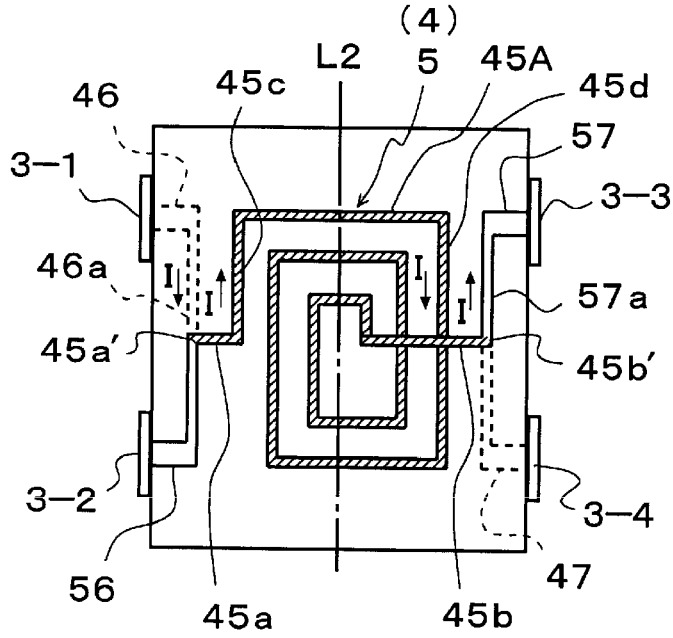
FIG. 6 is a plan view illustrating an overlapped state of the primary-side coil and the secondary-side coil when viewed from the upper side in the layer-overlying direction.

FIG. 4 is a plan view illustrating the primary-side coil 4 when viewed from the upper side in a layer-overlying direction (i.e., an up-and-down direction in FIGS. 1 to 3) of the multilayer transformer component 1. FIG. 5 is a plan view illustrating the secondary-side coil 5 when viewed from the upper side in the layer-overlying direction. FIG. 6 is a plan view illustrating an overlapped state of the primary-side coil 4 and the secondary-side coil 5 when viewed from the upper side in the layer-overlying direction. For ease of understanding, respective body portions of the primary-side and secondary-side coils 4, 5 are shown as hatched regions.

As illustrated in FIGS. 4 and 5, the first external electrode 3-1 and the second external electrode 3-2 are arranged side by side on the first end surface 21 of the chip body 2, and the third external electrode 3-3 and the fourth external electrode 3-4 are arranged side by side on the second end surface 22 which is located opposite to the first end surface 21.

Further, the first external electrode 3-1 and the third external electrode 3-3 are arranged opposite to each other, and the second external electrode 3-2 and the fourth external electrode 3-4 are arranged opposite to each other.

As illustrated in FIG. 4, the primary-side coil 4 is defined by the electrode pattern 41 and the electrode pattern 42. The primary-side coil 4 includes a body portion 45A shown as a hatched region, a first lead 46, and a second lead 47.

More specifically, the body portion 45A having a spiral shape includes a first projection 45*a* arranged to project from an outermost peripheral winding thereof toward the first end surface 21 of the chip body 2, and a second projection 45*b* arranged to project beyond the outermost peripheral winding thereof toward the second end surface 22. Further, the first and second projections 45*a*, 45*b* are arranged to lie on a linear line L1 perpendicular or substantially perpendicular to the first and second end surfaces 21, 22. In this preferred embodiment, the linear line L1 passes approximately through a center between the first and second external electrodes 3-1, 3-2 and a center between the third and fourth external electrodes 3-3, 3-4.

The first lead 46 is led out from a distal end 45*a*' of the first projection 45*a* of the body portion 45A and is connected to the first external electrode 3-1. The second lead 47 is led out from a distal end 45*b*' of the second projection 45*b* of the body portion 45A and is connected to the fourth external electrode 3-4.

As illustrated in FIG. 5, the secondary-side coil 5 is defined by the electrode pattern 51 and the electrode pattern 52. The secondary-side coil 5 includes a body portion shown as a hatched region, a third lead 56, and a fourth lead 57. The body portion of the secondary-side coil 5 has the same or substantially the same shape and the same winding direction as those of the body portion 45A of the primary-side coil 4, and is arranged at a location corresponding to the body portion 45A. Accordingly, when viewing at the primary-side and secondary-side coils 4, 5 from the upper side in the layer-overlying direction, as illustrated in FIG. 6, the body portion 45A of the primary-side coil 4 is hidden under the body portion of the secondary-side coil 5. In the following description, therefore, the body portion of the secondary-side coil 5 is also denoted by character "45A".

As illustrated in FIG. 5, the third lead 56 is led out from a distal end 45*a*' of a first projection 45*a* of the body portion 45A of the secondary-side coil 5 and is connected to the second external electrode 3-2. The fourth lead 57 is led out from a distal end 45*b*' of a second projection 45*b* of the body portion 45A thereof and is connected to the third external electrode 3-3.

The shapes of the first and second leads 46, 47 of the primary-side coil 4 and the third and fourth leads 56, 57 of the secondary-side coil 5 will be described below.

While, in this preferred embodiment, each of the first and second leads 46, 47 and the third and fourth leads 56, 57 preferably have a substantial L-shape as illustrated in FIG. 6, the lead shape is not limited to the substantially L-shape. However, each lead is configured to a shape that satisfies the following conditions.

Assuming a center line L2 which is disposed at an approximate center between the distal end 45*a*' of the first projection 45*a* and the distal end 45*b*' of the second projection 45*b* and which is perpendicular or substantially perpendicular to the layer-overlying direction (i.e., in the direction perpendicular or substantially perpendicular to a drawing sheet of FIG. 6), the first lead 46 of the primary-side coil 4 and the fourth lead 57 of the secondary-side coil 5 are configured to be line-symmetrical with respect to the center line L2. Further, the second lead 47 and the third lead 56 are also configured to be line-symmetrical with respect to the center line L2.

With the above-described configuration, an inductance value of the primary-side coil 4 and an inductance value of the secondary-side coil 5 are equal or substantially equal to each other.

More specifically, the primary-side coil 4 includes the first lead 46 indicated by broken lines, the body portion 45A, and the second lead 47 indicated by broken lines. A current I flowing through a portion 46*a* of the first lead 46 is in a reverse direction from the current I flowing through an outermost peripheral parallel winding 45*c* of the body portion 45A. Therefore, the inductance value of the primary-side coil 4 depends on portions of the primary-side coil 4 except for the portion 46*a* of the first lead 46 and the outermost peripheral parallel winding 45*c* of the body portion 45A.

On the other hand, the secondary-side coil 5 includes the third lead 56, the body portion 45A, and the fourth lead 57. A current I flowing through a portion 57*a* of the fourth lead 57 is in a reverse direction from the current I flowing through an outermost peripheral parallel winding 45*d* of the body portion 45A. Therefore, the inductance value of the secondary-side coil 5 depends on portions of the secondary-side coil 5 except for the portion 57*a* of the fourth lead 57 and the outermost peripheral parallel winding 45*d* of the body portion 45A.

In other words, portions of the respective body portions 45A except for the outermost peripheral parallel windings 45*c* and 45*d* are common to the primary-side coil 4 and the secondary-side coil 5. Furthermore, because the first lead 46 and the fourth lead 57 are line symmetrical with respect to the center line L2, a portion that remains after excluding the portion 46*a* from the first lead 46 and a portion that remains after excluding the portion 57*a* from the fourth lead 57 have the same or substantially the same length. In addition, because the third lead 56 and the second lead 47 are line symmetrical with respect to the center line L2, the leads 56 and 47 also have the same or substantially the same length.

As a result, the portions of the primary-side coil 4 which define its inductance value has the same or substantially the same length as the portions of the secondary-side coil 5 which define its inductance value. Thus, the respective inductance values of the primary-side coil 4 and the secondary-side coil 5 are equal or substantially equal to each other.

Operations and advantages of the multilayer transformer component according to a preferred embodiment of the present invention will be described below.

Figure 7:
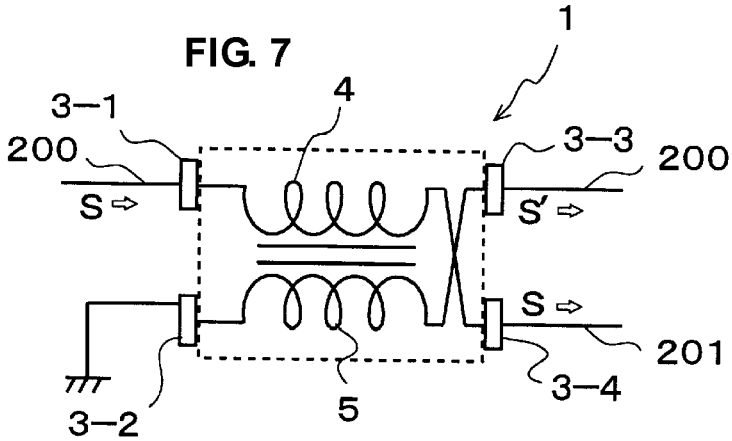
FIG. 7 is an equivalent circuit diagram of the multilayer transformer component according to the preferred embodiment shown in FIG. 1.
Figure 8:
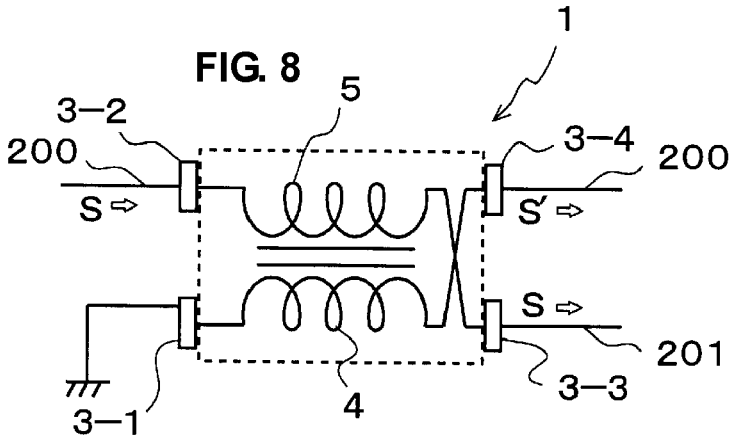
FIG. 8 is an equivalent circuit diagram in a state in which a mounting direction of the multilayer transformer component is changed.

FIG. 7 is an equivalent circuit diagram of the multilayer transformer component 1 according to a preferred embodiment of the present invention, the diagram illustrating a case in which the multilayer transformer component 1 is used as a multilayer balun transformer. FIG. 8 is an equivalent circuit diagram in a state in which a mounting direction of the multilayer transformer component 1 is changed.

In the multilayer transformer component 1, as illustrated in FIG. 7, left ends of the primary-side coil 4 and the secondary-side coil 5 both having the same or substantially the same inductance value are connected to the first external electrode 3-1 and the second external electrode 3-2, respectively, and right ends thereof are connected to the fourth external electrode 3-4 and the third external electrode 3-3, respectively, in a crossed state.

The first external electrode 3-1 and the third external electrode 3-3 of the multilayer transformer component 1 having the above-described configuration are each connected to a main line 200. The fourth external electrode 3-4 is connected to a sub-line 201 while the second external electrode 3-2 is grounded.

When a signal S is input through the first external electrode 3-1, a signal S' and the signal S both having the same power are output from the third external electrode 3-3 and the fourth external electrode 3-4, respectively.

In other words, the multilayer transformer component 1 can be used as a balun transformer of (1:1).

Further, as illustrated in FIG. 8, the mounting direction of the multilayer transformer component 1 is changed such that the second external electrode 3-2 and the fourth external electrode 3-4 are each connected to the main line 200, and the third external electrode 3-3 is connected to the sub-line 201 while the first external electrode 3-1 is grounded. When a signal S is input through the second external electrode 3-2, the signal S and a signal S' both having the same or substantially the same power are output from the third external electrode 3-3 and the fourth external electrode 3-4, respectively.

Such a result is attributable to the fact that, because the inductance value of the primary-side coil 4 and the inductance value of the secondary-side coil 5 are equal or substantially equal to each other as described above, the multilayer transformer component 1 functions as a multilayer balun transformer of (1:1) which does not experience characteristic variations regardless of the mounting direction.

To confirm the above-described point, the inventors conducted experiments as follows.

Figure 9:
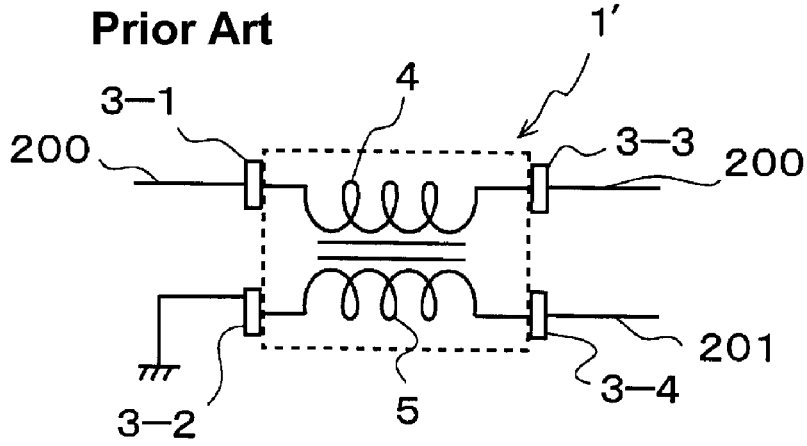
FIG. 9 Prior Art
FIG. 9 is an equivalent circuit diagram when a multilayer transformer component having a known structure is used as a balun transformer.
Figure 10:
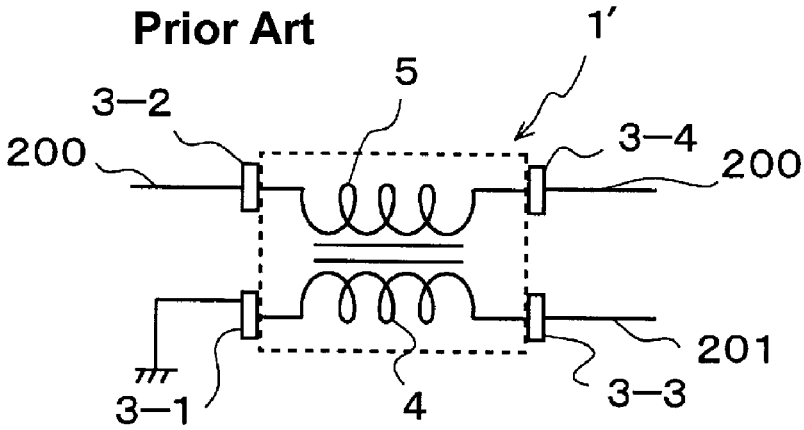
FIG. 10 Prior Art
FIG. 10 is an equivalent circuit diagram in a state where a mounting direction of the multilayer transformer component having the known structure is changed.

FIG. 9 is an equivalent circuit diagram when a multilayer transformer component having a known structure is used as a balun transformer. FIG. 10 is an equivalent circuit diagram in a state in which a mounting direction of the multilayer transformer component having the known structure is changed.

Figure 11:
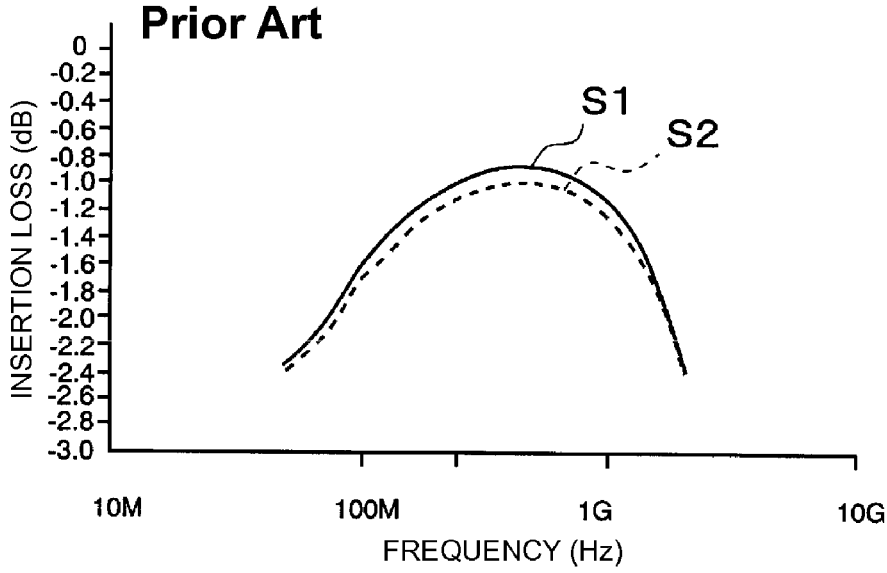
FIG. 11 Prior Art
FIG. 11 is a graph plotting insertion loss characteristics of the known multilayer transformer component.

FIG. 11 is a graph plotting insertion loss characteristics of the known multilayer transformer component.

Figure 16:
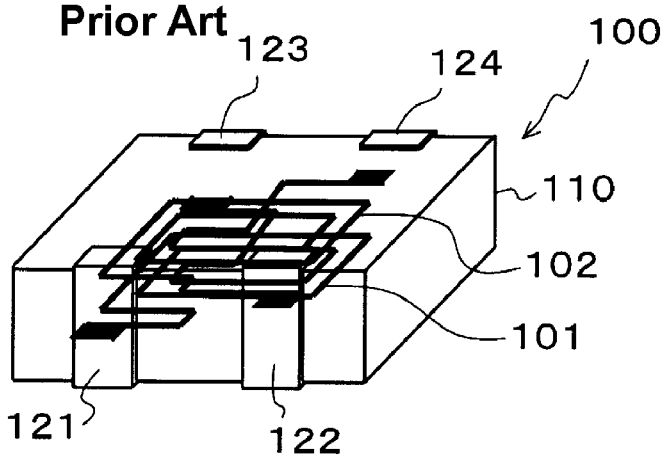
FIG. 16 Prior Art
FIG. 16 is a perspective view of the known multilayer transformer component, the view illustrating coil portions in a see-through view.

First, as illustrated in FIG. 9, a multilayer transformer component 1' similar to the known multilayer transformer component 100, illustrated in FIG. 16, was used in this experiment. In more detail, the multilayer transformer component 1' was used as a balun transformer in a state in which left ends of the primary-side coil 4 and the secondary-side coil 5 of the multilayer transformer component 1' were connected respectively to the first external electrode 3-1 and the second external electrode 3-2, and in which right ends thereof were connected respectively to the third external electrode 3-3 and the fourth external electrode 3-4 without crossing each other.

The insertion loss of the multilayer transformer component 1' was measured in a state in which the first external electrode 3-1 and the third external electrode 3-3 of the multilayer transformer component 1' were connected to a main line 200, while the second external electrode 3-2 was grounded. As a result, a satisfactory insertion loss characteristic as a balun transformer of (1:1) was obtained as indicated by a solid-line curve S1 in FIG. 11.

Figure 17A:
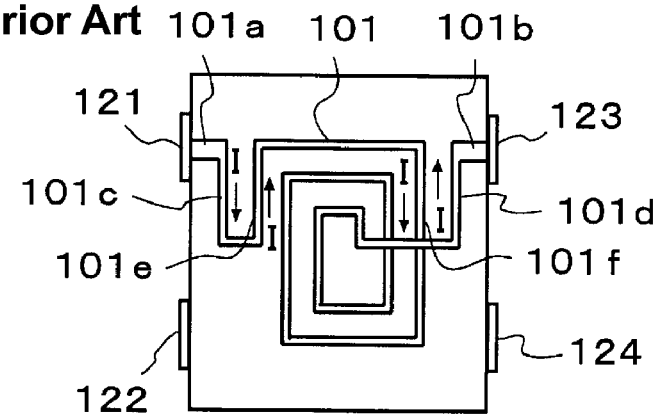
FIG. 17A Prior Art
FIGS. 17A and 17B are plan views illustrating connection states of external electrodes and coils.
Figure 17B:
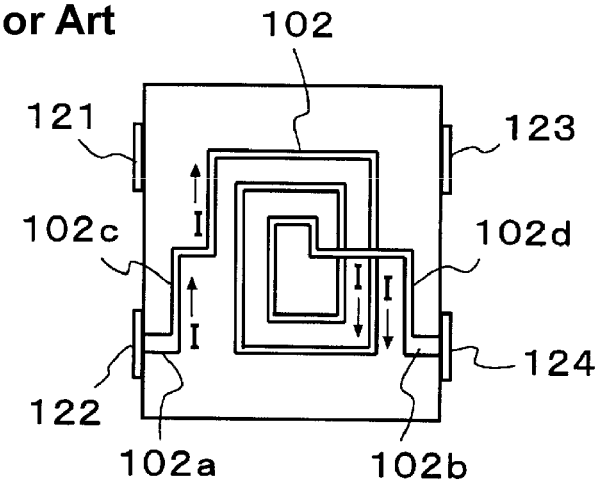
FIG. 17B Prior Art

Next, the insertion loss of the multilayer transformer component 1' was measured after changing the mounting direction of the multilayer transformer component 1' as illustrated in FIG. 10. The measurement result shows a deterioration of the insertion loss characteristic, as indicated by a broken-line curve S2 in FIG. 11. The reason for this is presumably that, as described above with reference to FIGS. 16 and 17, a difference occurs in the inductance value between the primary-side coil and the secondary-side coil in the multilayer transformer component 1' having the known structure.

As understood from the above description, when the multilayer transformer component 1' having the known structure is used as a balun transformer, the insertion loss differs to a large extent and the characteristic variations are increased depending on the mounting direction.

Next, the inventors conducted similar measurements on the multilayer transformer component 1 according to a preferred embodiment of the present invention.

Figure 12:
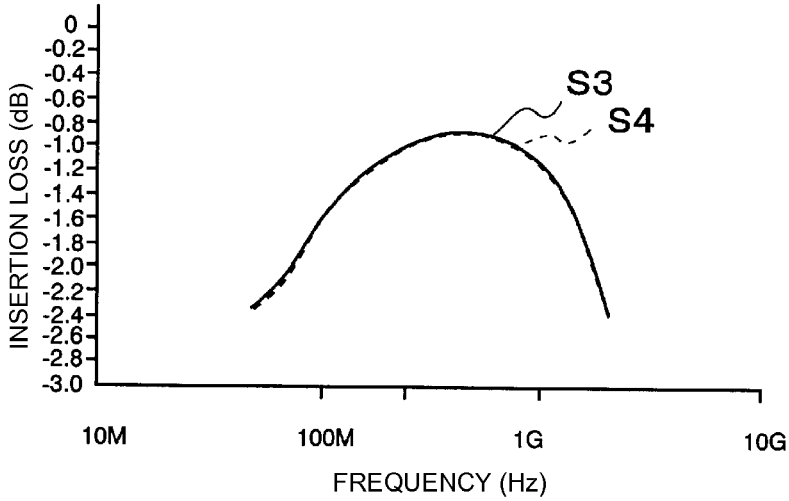
FIG. 12 is a graph plotting insertion loss characteristics of the multilayer transformer component according to the preferred embodiment shown in FIG. 1.

FIG. 12 is a graph plotting insertion loss characteristics of the multilayer transformer component 1 according to a preferred embodiment of the present invention.

The multilayer transformer component 1 according to a preferred embodiment of the present invention was used as a balun transformer and the insertion losses thereof were measured with the mounting direction changed as illustrated in FIGS. 7 and 8. In the mounting state illustrated in FIG. 7, a satisfactory insertion loss characteristic similar to the solid-line curve S1 in FIG. 11 was obtained as indicated by a solid-line curve S3 in FIG. 12. In addition, in the mounting state illustrated in FIG. 8, a satisfactory insertion loss characteristic that substantially matches the curve S3 was obtained as indicated by a broken-line curve S4 in FIG. 12. The reason for this is presumably that, as described above with reference to FIG. 6, the respective inductance values of the primary-side coil 4 and the secondary-side coil 5 are set to be equal or substantially equal to each other in the multilayer transformer component 1 according to a preferred embodiment of the present invention.

Thus, with the multilayer transformer component 1 according to a preferred embodiment of the present invention, the insertion loss characteristic does not differ depending on the mounting direction. Therefore, the multilayer transformer component 1 can be used as a balun transformer of (1:1) with no characteristic variations depending on the mounting direction.

The multilayer transformer component 1 according to a preferred embodiment of the present invention can also be used as a common-mode choke coil.

Figure 13:
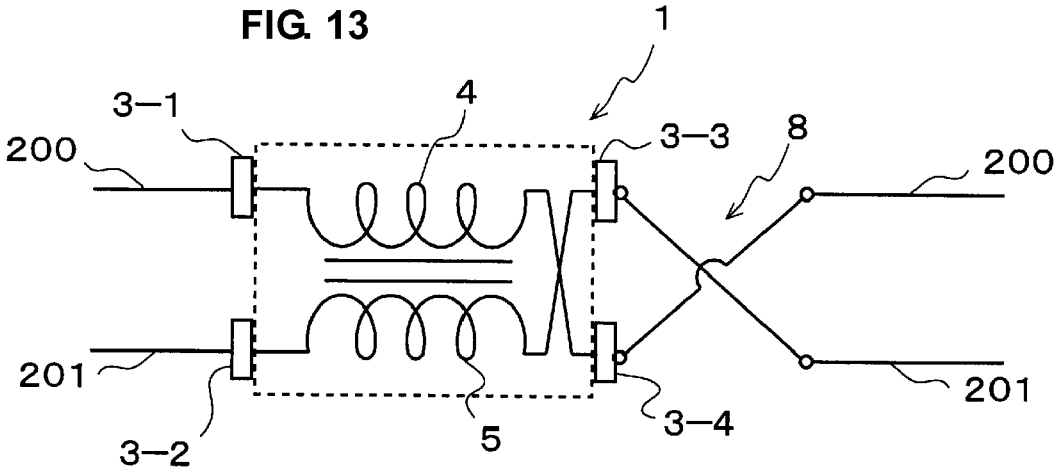
FIG. 13 is an equivalent circuit diagram when the multilayer transformer component according to a preferred embodiment is used as a common-mode choke coil.

FIG. 13 is an equivalent circuit diagram when the multilayer transformer component according to the example is used as a common-mode choke coil.

As illustrated in FIG. 13, the first external electrode 3-1 of the multilayer transformer component 1 is connected to one differential line 200, and the second external electrode 3-2 thereof is connected to the other differential line 201. Furthermore, through a crossing circuit 8 preferably defined by, e.g., a twisted wire or a circuit board, the third external electrode 3-3 is connected to the other differential line 201 and the fourth external electrode 3-4 is connected to the one differential line 200. The crossing circuit 8 may preferably be arranged at a midpoint of the differential lines 200 and 201. This provides a state in which the primary-side coil 4 of the multilayer transformer component 1 is connected to the one differential line 200 and the secondary-side coil 5 thereof is connected to the other differential line 201.

In such a connection state, when common-mode noise enters the differential lines 200 and 201, the multilayer transformer component 1 provides high impedance to remove the common-mode noise. At that time, if the inductance value differs between the primary-side coil 4 and the secondary-side coil 5, a common mode noise removing effect is deteriorated.

In addition, when differential signals having reversed phases from one another flow through the differential lines 200 and 201, the differential signals flow in the multilayer transformer component 1 through the primary-side coil 4 and the secondary-side coil 5, respectively. Thereafter, the differential signals are output to the differential lines 200 and 201.

At that time, if the inductance value differs between the primary-side coil 4 and the secondary-side coil 5, the two differential signals have different powers.

However, with the multilayer transformer component 1 according to a preferred embodiment of the present invention, since the inductance values of the primary-side coil 4 and the secondary-side coil 5 are equal or substantially equal to each other, the effect of removing the common-mode noise will not deteriorate, and the output differential signals will not have different powers. Thus, the multilayer transformer component 1 can also be used as the common-mode choke coil having satisfactory characteristics.

It is noted that the present invention is not limited to the above-described preferred embodiments and the present invention can be variously changed and modified within the scope of the present invention.

For example, while the primary-side coil 4 and the secondary-side coil 5 have been described in the preferred embodiments as the primary-side coil 4 and the secondary-side coil 5 each of which has a substantial vortex shape in which a winding size gradually decreases with an increase in the number of windings, the present invention is not limited to these coils. Alternatively, a spiral coil having a substantially constant winding size can also be used for each of the primary-side coil and the secondary-side coil.

Figure 14A:
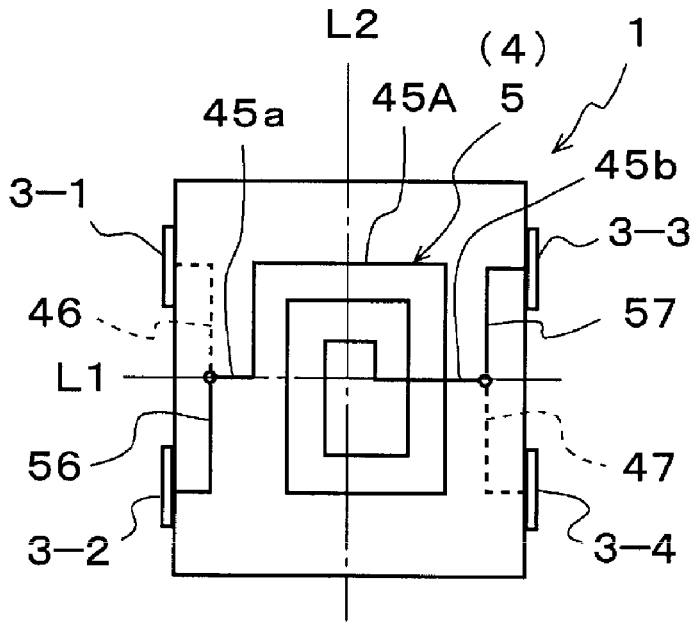
FIGS. 14A and 14B are schematic plan views of the structure of the multilayer transformer component according to the preferred embodiment shown in FIG. 1.

Further, in the multilayer transformer component 1 according to the above-described preferred embodiments as illustrated in FIG. 14A, the first projections 45*a* and the second projections 45*b* projecting from the respective body portions 45A of the primary-side coil 4 and the secondary-side coil 5 are preferably arranged to lie substantially on the linear line L1 passing through the center between the first and second external electrodes 3-1, 3-2 and the center between the third and fourth external electrodes 3-3, 3-4. However, the arrangement of the first and second projections 45*a* and 45*b* is not limited thereto.

The first projections 45*a* and the second projections 45*b* are only required to be arranged to lie substantially on the linear line L1, and the linear line is not required to be located at the approximate center between the first and second external electrodes 3-1, 3-2, etc. In other words, it is only required that, as long as the first and second projections 45*a*, 45*b* are arranged to lie substantially on the linear line, the first lead 46 and the fourth lead 57 arranged to be line-symmetrical with respect to the above-mentioned center line L2, and the second lead 47 and the third lead 56 are also arranged to be line-symmetrical with respect to the center line L2.

Thus, various multilayer transformer components in which the linear line is disposed at different locations can be used as modifications of the above-described preferred embodiments.

The modifications of the above-described preferred embodiments will be described below with reference to FIGS. 15A to 15D.

Figure 14B:
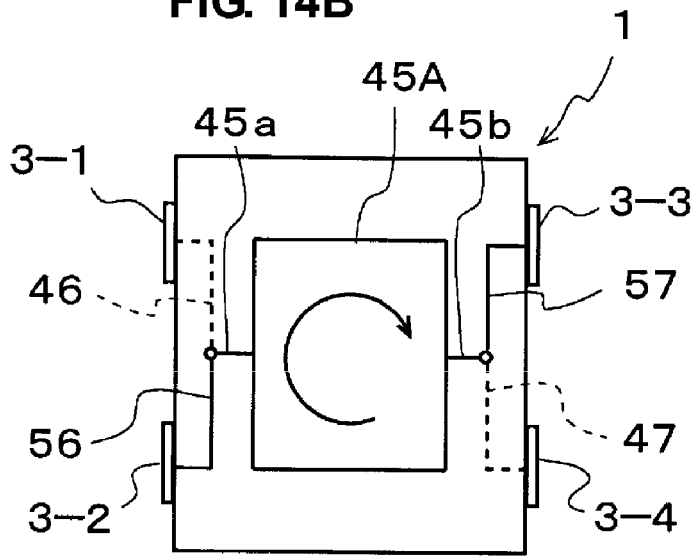

It is noted that, in the multilayer transformer component 1 illustrated in FIG. 14A, the body portion 45A except for the first and second projections 45*a*, 45*b* can be shown as a black box as illustrated in FIG. 14B. Accordingly, the body portion 45A is shown as a black box in FIGS. 15A to 15D.

Figure 15A:
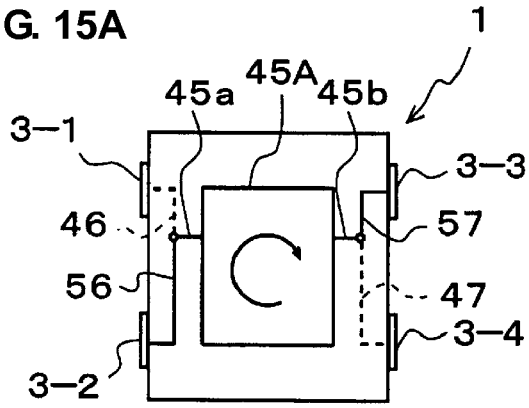
FIGS. 15A to 15D are schematic plan views illustrating various modifications of the preferred embodiment shown in FIG. 1.

First, as illustrated in FIG. 15A, the location of the linear line, i.e., the locations of the first and second projections 45*a*, 45*b*, may preferably be shifted from the approximate center between the first and second external electrodes 3-1, 3-2, for example. Such a modified multilayer transformer component can also provide similar operating advantages to those of the multilayer transformer component 1 according to a preferred embodiment of the present invention.

Figure 15B:
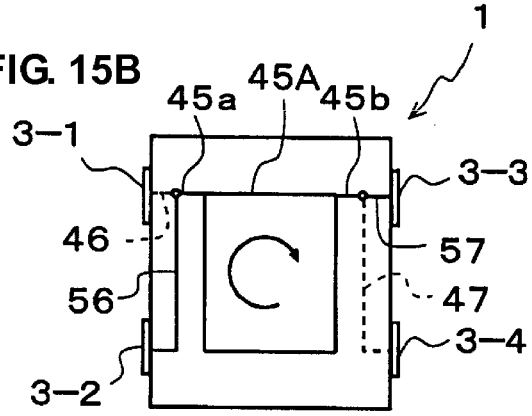
Figure 15C:
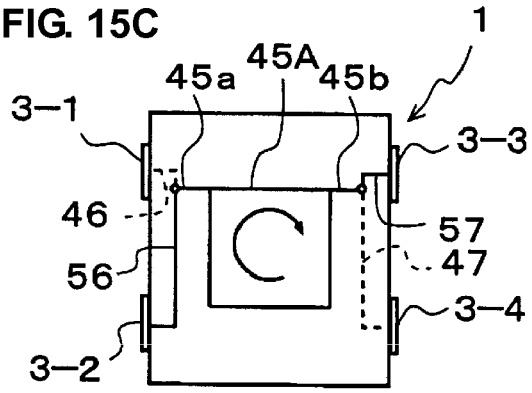

Further, as illustrated in FIGS. 15B and 15C, the locations of the first and second projections 45*a*, 45*b* may preferably be at upper and lower outermost peripheries of the body portion 45A. Such modified multilayer transformer components can also provide similar operating advantages to those of the multilayer transformer component 1 according to a preferred embodiment of the present invention.

Figure 15D:
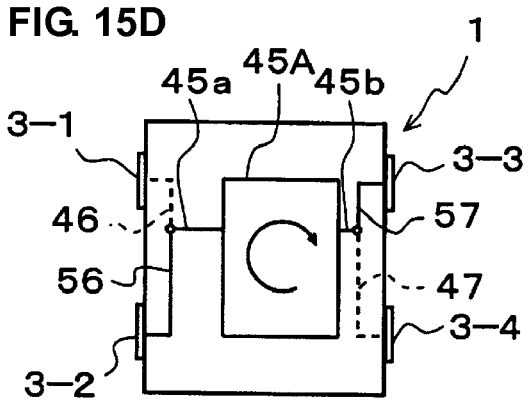

In addition, as illustrated in FIG. 15D, the first and second projections 45*a*, 45*b* may preferably have different lengths from each other. Such a modified multilayer transformer component can also provide similar operating advantages to those of the multilayer transformer component 1 according to a preferred embodiment of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A multilayer transformer component comprising:

a chip body including an insulator, and a primary-side coil and a secondary-side coil layered within the insulator and including body portions having the same or substantially the same shape and being wound in the same winding direction; and a first external electrode disposed on a first end surface of the chip body;

a second external electrode disposed on the first end surface in a side-by-side relation to the first external electrode;

a third external electrode disposed on a second end surface opposite to the first end surface and arranged opposite to the first external electrode; and a fourth external electrode disposed on the second end surface in a side-by-side relation to the third external electrode and arranged opposite to the second external electrode; wherein each of the body portions of the primary-side coil and the secondary-side coil includes a first projection arranged to project from an outermost peripheral winding of the body portion toward the first end surface and a second projection arranged to project from the outermost peripheral winding toward the second end surface, the first and second projections being arranged to lie substantially on a linear line extending perpendicular or substantially perpendicular to the first and second end surfaces;

a first lead that is led out from a distal end of the first projection of the body portion in the primary-side coil is connected to the first external electrode, and a second lead that is led out from a distal end of the second projection of the body portion in the primary side is connected to the fourth external electrode;

a third lead that is led out from a distal end of the first projection of the body portion in the secondary-side coil is connected to the second external electrode, and a fourth lead that is led out from a distal end of the second projection of the body portion in the secondary side is connected to the third external electrode; and the first lead and the fourth lead are arranged to be line-symmetrical with respect to a center line which is disposed at an approximate center between the distal end of the first projection and the distal end of the second projection when viewed in an overlying direction of the primary-side coil and the secondary-side coil, and which is perpendicular or substantially perpendicular to the overlying direction, the second lead and the third lead being arranged to be line-symmetrical with respect to the center line when viewed in the overlying direction.

2. The multilayer transformer component according to claim 1, wherein the multilayer transformer component is a multilayer balun transformer.

* * * * *